US005154649A

United States Patent [19]

Pender

[11] Patent Number: 5,154,649

[45] Date of Patent: Oct. 13, 1992

[54] INFLATABLE NURSING PILLOW

[76] Inventor: Vicki Pender, 6 Vallejo St., Berkeley, Calif. 94707

[21] Appl. No.: 758,986

[22] Filed: Sep. 10, 1991

[51] Int. Cl.[5] ..... A47C 20/02

[52] U.S. Cl. ..... 5/655; 5/652

[58] Field of Search ..... 5/431, 436, 437, 441, 5/442, 490, 652, 655, 630

[56] References Cited

U.S. PATENT DOCUMENTS

| | | | |
|---|---|---|---|
| 2,446,396 | 8/1948 | Waranch | 5/490 |
| 3,298,044 | 1/1967 | Saltness et al. | 5/441 |
| 3,644,949 | 2/1972 | Diamond | 5/441 |
| 3,788,699 | 1/1974 | Starr | 5/436 X |
| 4,305,520 | 7/1983 | Koch | 5/436 X |
| 4,731,890 | 3/1988 | Roberts | 5/436 X |
| 5,029,351 | 7/1991 | Weber | 5/431 |

FOREIGN PATENT DOCUMENTS

| | | | |
|---|---|---|---|
| 8911264 | 11/1989 | PCT Int'l Appl. | 5/431 |

*Primary Examiner*—Michael F. Trettel
*Attorney, Agent, or Firm*—Townsend and Townsend

[57] ABSTRACT

An inflatable nursing pillow having multiple air chambers which provide adjustability of air pressure and customized support for a child during bottle and breast-feeding. The device is anatomically shaped in a substantially yoke shaped configuration to extend around the user's torso and provide support for either left-handed or right-handed feeding. Each air chamber has an independent air valve to allow separate adjustment of air pressure. This adjustability allows customized support and adaptation for the size of the child, position of the user and child, and adaptation with chair arms, bed railings, or other physical constraints. The invention includes a removable elastic cover which provides a soft and moisture absorbent outer surface which can be easily changed and washed. The device is fully portable and can be deflated for storage or transportation and folded up into small dimensions for convenient carrying in a handbag or other suitable article.

4 Claims, 3 Drawing Sheets

INFLATABLE NURSING PILLOW

BACKGROUND OF THE INVENTION

The invention relates generally to a support device used when nursing or bottle-feeding of infants. More specifically, the invention relates to an inflatable ergonomic pillow to provide adjustable support for the user's arms and back while the child is being held during mealtime.

Bottle-feeding and breast-feeding of newborn babies requires the mother to support and cradle the infant close to the bosom using her arm and elbow. Prolonged or repetitive nursing often causes the mother to suffer pain and fatigue in the elbows, arms, wrists and back. As a result, various devices are employed to help support the weight of the infant and thereby make nursing more comfortable. These devices have been developed from the recognition that bottle and breast-feeding can be compromised when the mother is uncomfortable and unable to provide adequate support for the infant.

In hospital situations for newborn or infant care, hospitals typically provide conventional pillows to nursing mothers for use in a support function. Commonly, only one such pillow is provided per bed. A conventional bed pillow, however, must often be doubled-up or folded to provide meaningful support under the mother's elbow and forearm and below the infant's body. It is difficult for the mother to obtain sufficient support using a conventional single pillow even when the mother is in the sitting position. The problem is compounded in that most hospital beds are narrow and have upwardly extending railings which inhibit proper positioning of pillows when used to provide support on the side of the mother below the elbow.

One prior art device designed to provide nursing support employs foamed material in the shape of a wedge. The foam wedge nursing support is disadvantageous due to its relatively fixed size and configuration. When such a foamed nursing support is configured to provide optimal support for an extremely young and small infant, the dimensions will prove to be inadequate within a short period of time as the infant grows in size. Therefore, it is conceivable that several sized foam wedges would have to be employed if the mother chooses to bottle or breast-feed the infant over extended calendar periods of time. Additionally, foam structures can potentially absorb moisture and are difficult to clean. Likewise, conventional feather or foam bed pillows suffer from the same disadvantages.

Oval shaped, single chamber air mattresses have been employed to provide support for arms during breast and bottlefeeding. These prior art devices suffer from disadvantages associated with the shape and single chamber construction. An oval shaped air cushion must be positioned about the torso in a suitable manner to provide proper support for the mother's left or right arm, as required. The oval shape does not lend itself to equal support on both sides of the mother's body. Therefore, when the feeding position changes, so must the position of the oval support.

Additionally, single air chamber construction fails to provide adequate support without relatively high pressure inflation. Low pressure inflation, however, may be necessary to reduce the height or size of the air cushion for the particular application or to facilitate adaptation around uneven surfaces, railings, arm rests or the like. When the inflation pressure is reduced to accommodate these obstructions, the support provided by the air pillow is compromised. In many circumstances, it is not feasible to inflate a single chamber structure to the pressure required to provide adequate support. The size of the child being fed, position of the user, posture, and surrounding physical constraints all impact where such an oval, single chamber air pillow must be positioned and to what pressure it is inflated. As a result, in many circumstances, these prior art devices prove to be inadequate.

SUMMARY OF THE INVENTION

In accordance with the present invention, a multi-chambered, anatomically-shaped nursing pillow is provided which furnishes fully adjustable support and can be used either during right-handed or left-handed bottle or breast-feeding without repositioning. The invention has a substantially yoke or crescent shaped body incorporating two or more separate air chambers which can be independently adjusted. The symmetrical and anatomical shape of the nursing pillow is designed for use by men and women and allows the device to be placed in front of the user's torso to provide support on either side of the user below both the left and right elbow and forearm. A detachable belt can be provided to secure the nursing pillow about a users torso to restrict movement of the pillow during use.

Each air chamber in the invention has an independent air valve which allows adjustability of the air pressure to custom fit the support characteristics to the size of the infant and the position and application desired by the user. Each air chamber occupies the entire length and width of the device. The air chambers are therefore stacked vertically to provide a wide range of adjustability without compromising support for the infant. The device is fully portable and can be deflated for storage or transportation and folded up into small dimensions for convening carrying in a handbag or other suitable article.

Preferably, the nursing pillow is constructed of a durable, polyvinylchloride (PVC) material to provide a high puncture-resistance. The device includes a soft, fabric outer cover which is contoured to fit over and fully envelope the device to provide a smooth, moisture absorbent outer surface. The cover is removable to allow ease of washing and replacement, and can include elastic material or panels to provide a snug fit regardless of inflation pressure in the air chambers.

DESCRIPTION OF THE PREFERRED EMBODIMENT

Figure 1:
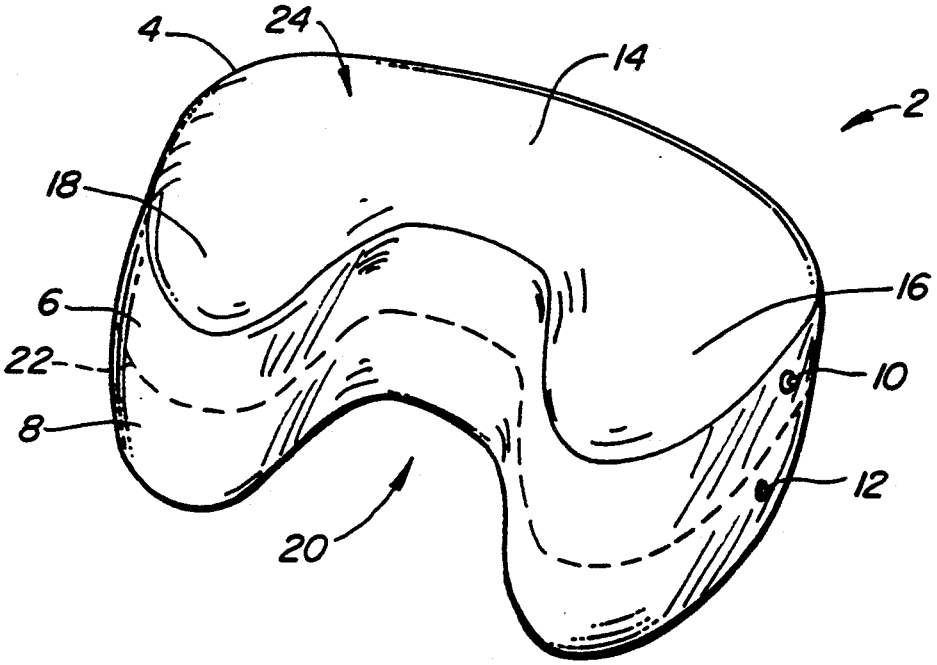
FIG. 1 is a perspective view of the preferred embodiment of the invention showing the two air chambers in the fully inflated position.

FIG. 1 illustrates the preferred embodiment of the invention shown in the fully-inflated condition and in the perspective view. Nursing pillow 2 includes yoke-shaped air bladder 4 having first air chamber 6 and second air chamber 8. First air chamber 6 and second air chamber 8 are independently inflatable, having first air valve 10 and second air valve 12 respectively. First air chamber 6 and second air chamber 8 share common wall 22 indicated by broken lines. In the preferred embodiment, first air chamber 6 occupies approximately one-half of the available volume of air capacity of yoke-shaped air bladder 4. Second air chamber 8 occupies the second half of the air volume available in yoke-shaped air bladder 4.

Yoke-shaped air bladder 4 is ergonomically and anatomically shaped to provide fully adjustable support for bottle or breast-feeding a child in either the left-handed or right-handed configuration. Nursing pillow 2 is constructing having a substantially yoke-shaped or crescent-shaped configuration which, when inflated, is adapted to provide a support surface around the front and each side of the users torso. Yoke-shaped air bladder 4 is substantially symmetrical from side to side and top to bottom. Therefore, there is no "right" side up dictated by the construction of the invention. Yoke-shaped air bladder 4 generally has a front portion 14, side portion 16 and side portion 18. Side portion 16 and side portion 18 are separated by torso recess 20. It is intended that the user position herself generally in the torso recess 20 such that front portion 14 generally lies in front of the user and the side portions 16 and 18 generally lie on either side of the user's torso. Positioned in this way, side portion 16 can be used to provide elbow support for the user's right arm and side portion 18 can be used to provide support for the user's left arm.

Figure 2:
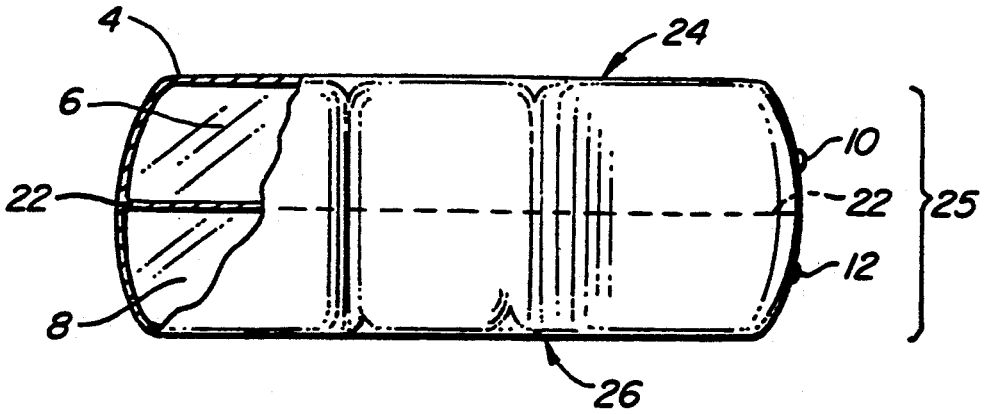
FIG. 2 is a side view of the device shown in FIG. 1.

Referring now to FIG. 2, a front view is shown of the preferred embodiment of the invention. Although the device is symmetrical as previously described, for purposes of discussion, one side shall be designated upper surface 24 and the opposite side shall be designated lower surface 26. First air chamber 6 and second air chamber 8 are separated by common wall 22 which lies in a substantially horizontal plane when viewed from this front view illustration. First air chamber 6 has first air valve 10 to facilitate manual adjustment of air pressure within first air chamber 6. Likewise, second air chamber 8 includes second air valve 12 which provides for manual air pressure adjustability of second air chamber 8. Preferably, yoke-shaped air bladder 4 is constructed using flexible polyvinylchloride (PVC) material or acceptable substitute. Yoke-shaped air bladder can be made using a plurality of independent plastic sheets which are connected together at airtight seams using appropriate conventional bonding techniques used in other air mattress or bladder type structures well-known in the art. The material and thickness of the PVC or plastic used to construct yoke-shaped air bladder 4 is selected to provide sufficient puncture resistance and durability while allowing flexibility and foldability for storage when in the deflated condition.

First air valve 10 and second air valve 12 are preferably standard plastic oral inflator valves which can be manually opened and closed by the user and orally inflated. The valves are similar to those conventionally found in everyday beach toys and pool floats. Alternatively, first air valve 10 and second air valve 12 can be configured to accept a small hand-held air pump (not shown), a compressed air cartridge device or similar mechanical inflator as desired. The construction materials used and the valve systems employed should preferably be sufficient to withstand pressures between 5 and 20 psi.

Figure 3:
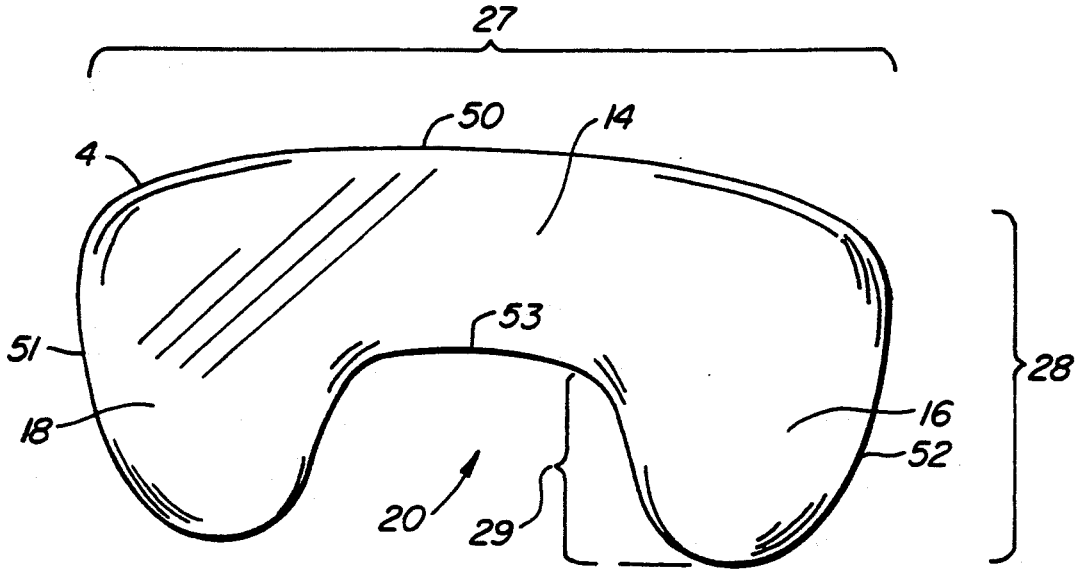
FIG. 3 is a top view of the device shown in FIG. 1.

Referring now to FIG. 3, a top view of the preferred embodiment of the invention is shown. The curvature of yokeshaped air bladder 4 is specifically designed to provide a universal support surface which can be used for either righthanded or left-handed feeding by men or women. Generally speaking, the configuration includes front portion 14, side portion 16 and side portion 18 as previously described. Side portion 16 and side portion 18 are generally separated by torso recess 20. In the preferred embodiment, the invention is sized to have a width 27 of approximately 29–30 inches. Depth 28 is preferably approximately 14 inches. Depth 29 of torso recess 20 preferably recedes approximately 7 inches. These dimensions are approximations for the fully inflated condition. From the top view of FIG. 3, it is apparent that yoke-shaped air bladder 4 has a region 50 of relatively large and essentially constant radius, extending at each end into areas 51, 52 of smaller and decreasing radius, converging at the recess 20 defined by a region 53 of reverse curvature.

Also, in the fully inflated condition, the preferred embodiment has height 25 of approximately 10 inches, with first air chamber 6 having an approximate 5 inch height and second air chamber 8 having an approximate 5 inch height. These dimensions can be changed substantially according to the particular application desired The preferred dimensions are merely provided to show approximate sizing which can be used to construction the device in a configuration which will provide suitable support for most infants and adapt to a wide number of users. The dimensions can be substantially changed to provide different sizes and configurations without compromising the general benefits of the invention.

Figure 4:
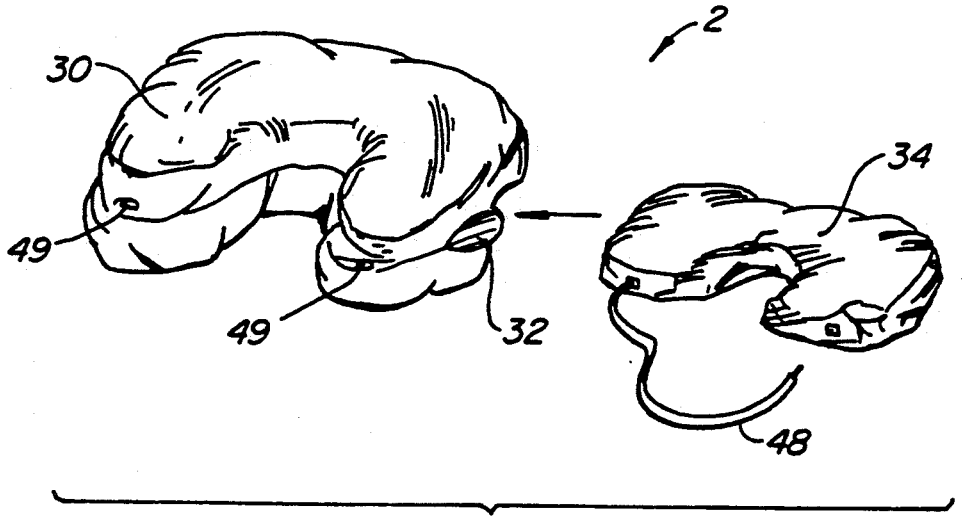
FIG. 4 is a perspective view of the invention shown in the condition and separated from the removable cover, the removable cover illustrated with an opening to allow placement of the air bladder member into the cover.

Referring now to FIG. 4, the preferred embodiment of the invention is shown including yoke-shaped air bladder 34, illustrated in the substantially deflated condition, and removable cover 30. Cover 30 is constructed to fully envelope and encase yoke-shaped air bladder 4, 34 when in the fully inflated condition and provide a smooth, soft outer surface of nursing pillow 2. Removable cover 30 is preferably fabricated from cotton fabric and can be made in a wide range of colors and patterns to enhance aesthetic appearance. Cotton 30 provides a substantially non-allergenic fabric which is soft, durable, moisture absorbent and easily washable. Alternatively, cover 30 can be fabricated from a wide range of suitable materials such as sheepskin, fleece, nylon, LYCRA® EXPANDABLE FABRIC (a registered trademark of DuPont Corporation), polypropylene, polyester, POLARPLUS® fabric (a registered trademark of Malden Mills Industries, Inc.) or other suitable materials or combinations as desired. Additionally, elastic panels can be incorporated into the construction of cover 30 to facilitate a tight fit regardless of inflation pressure of yoke-shaped air bladder 4.

Cover 30 includes opening flap 32 to allow air bladder 34 to be inserted into and removed from cover 30. Preferably, opening flap is made to align with first air valve 10 and second air valve 12. Opening flap 32 can be made with overlapping material, have appropriate closures. Preferably, VELCRO ® (a registered trademark of Velcro U.S.A., Inc.) is used as a closure device. Alternatively, a zipper, snaps, or other suitable fasteners could be used.

Figure 5:
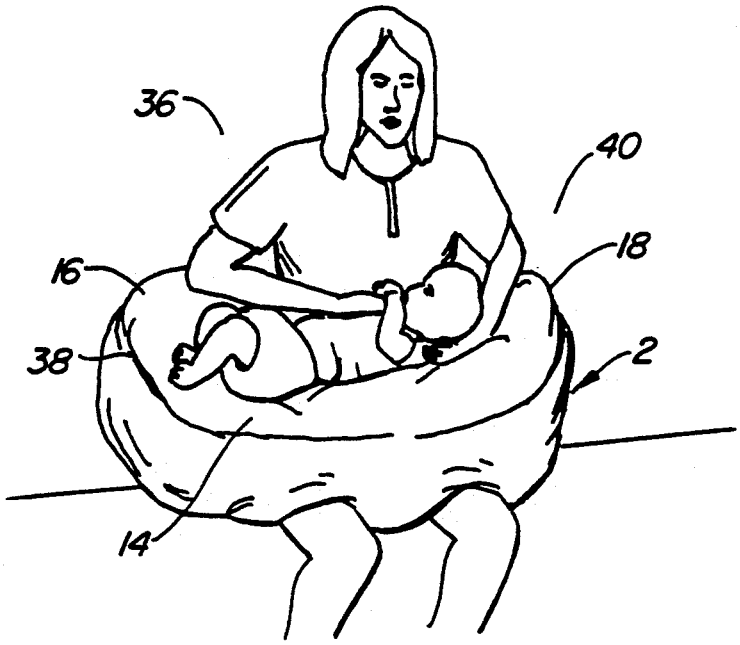
FIG. 5 is a perspective view of the invention shown being used by a mother and supporting a child in the nursing position.

FIG. 5 illustrates the invention being employed for its intended use. As illustrated, the shape and configuration of nursing pillow 2 cradles the user and provides fully adjustable support for the infant and the arms of the user. Nursing pillow 2 is shown disposed about the torso of user 36, having infant 38 in the bottle-nursing, or breast-feeding position. As such, the elbow 40 of user 36 is supported by side portion 18. The body of the infant 38 is supported by front portion 14 and partially by side portion 16. The pressure of nursing pillow 2 can be adjusted to provide variable height, support and cushioning for both user 36 and infant 38.

In addition, a removable belt 48 can be provided to secure the nursing pillow 2 around the users lower torso to restrict the air bladder 34 from inadvertent movement away from the user during use. Belt 48 can be made of any suitable material such as nylon, and is preferably fastened to air bladder 34 using conventional clip fasteners or VELCRO ® located along side portions 16 and 18. Cover 30 includes access openings to allow belt 48 to be fastened to air bladder 34. Alternatively, belt 48 can be constructed to attach directly to cover 30 using suitable means.

Figure 6:
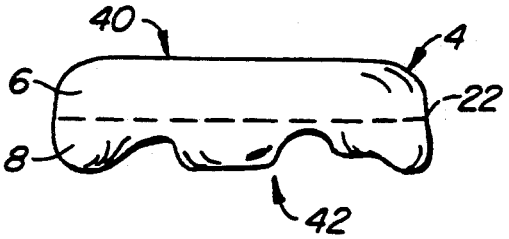
FIG. 6 is a side view of the preferred embodiment shown in FIG. 1 illustrating the lower of the two chambers in a partially inflated condition to allow adaptation of the invention over an uneven contoured surface while providing level support.
Figure 7:
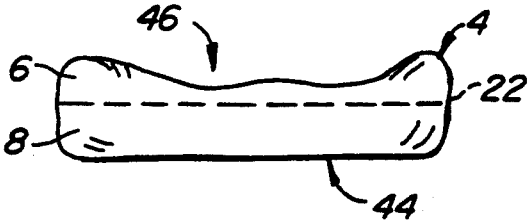
FIG. 7 is a side view of the preferred embodiment shown in FIG. 1, illustrated having the upper of the two chambers in a partially deflated condition.

The adjustability of the preferred dual chamber construction of yoke-shaped air bladder 4 is shown in FIGS. 6 and 7 illustrating a front view of the preferred embodiment of the invention and the independent adjustability of first air chamber 6 and second air chamber 8. Referring first to FIG. 6, the preferred embodiment is shown having first air chamber 6 in the fully inflated condition with second air chamber 8 in a partially inflated condition. This configuration would be suitable in providing a firm support upper surface 40 while allowing lower surface 42 to adapt to surface irregularity and contours such as the user's legs when the device is employed while in the sitting position, chair arm rests, or the like. FIG. 7 illustrates the preferred embodiment of the invention with first air chamber 6 in the partially inflated condition and second air chamber 8 in the fully inflated condition. This configuration would be suitable to allow a firm lower support surface 44 while providing a softer, more cradling upper surface 46 which can be used to more comfortably cushion the infant, or to reduce the vertical height of yoke-shaped air bladder 4 for the particular circumstances.

Figure 8:
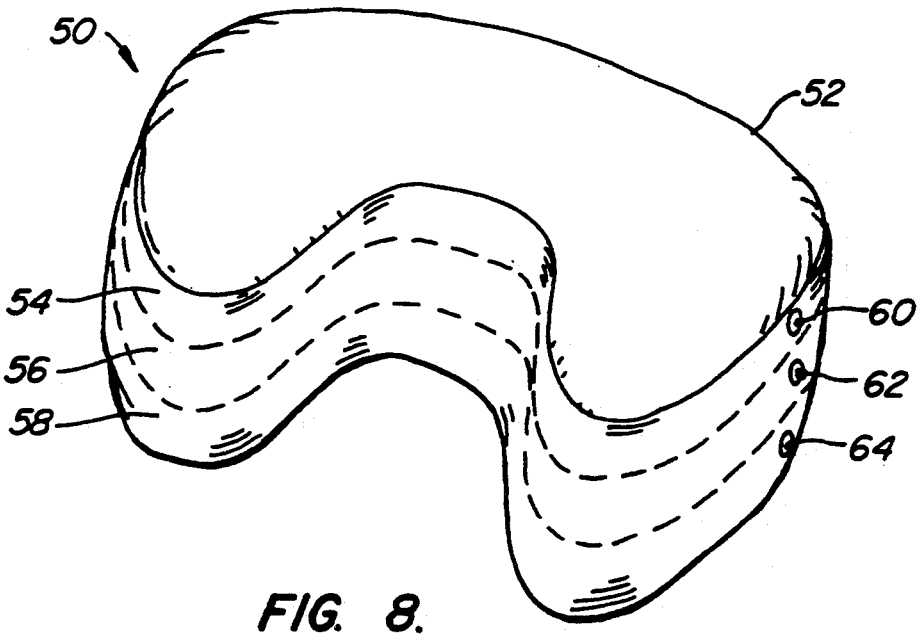
FIG. 8 is a perspective view of an alternative embodiment of the invention having three independent air chambers.

FIG. 8 illustrates an alternative embodiment of the invention. In the alternative embodiment, nursing pillow 50 is made substantially as previously described but having 3 substantially equal sized independent air chambers. In this embodiment, yoke-shaped air bladder 52 includes first air chamber 54, second air chamber 56 and third air chamber 58. First air chamber 54 is coupled to first air valve 60, second air chamber 56 is coupled to second air valve 62, and third air chamber 58 is coupled to third air valve 64. This embodiment of the invention incorporates all the other attributes and characteristics including preferred dimensions as discussed in the preferred embodiment with adjustments in the height of each chamber as appropriate. The additional air chamber of the alternative construction allows an added degree of adjustability for the user. For example, in the alternative embodiment, second air chamber 56 can be inflated to the fully inflated condition while first air chamber 54 and third air chamber 58 can be partially inflated to allow adaptation to irregular surfaces or to very vertical height of nursing pillow 50. In this configuration, the fully inflated second air chamber 56 would provide firm, and adequate support while yoke-shaped air bladder 52 would have fully adaptability to contours and the irregular surfaces.

The foregoing description of the preferred embodiments of the invention have been presented for purposes of illustration and description. It is not intended to be exhaustive or to limit the invention to the precise form disclosed, and obviously many modifications and variations are possible in light of the above teaching. For example, yokeshaped air bladder 4, 52, could be fabricated having a plurality of independent air chambers in greater number than that discussed in the specification. Four, five, or more chambers could be incorporated. Additionally, the air chambers could be configured to be disposed within different locations of yoke-shaped air bladder 4, 52 to provide enhanced adjustability as to height of the device by providing independent air chambers for both first side portion 16 and second side portion 18 as desired. As many air chambers as desired could be incorporated to vary the adjustability of the device. Additionally, one or more of the chambers could be filled with other than air to provide a different fluid density or resiliency. Foam pads or gels could be used.

The embodiments chosen and described in this description were selected to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A nursing pillow, comprising:

an inflatable body constructed of polyvinylchloride material and having an upper and a lower region, said body including a first inflatable air chamber disposed across said body in the lower region and coupled to a first air valve, and a second inflatable air chamber disposed across said body in the upper region and coupled to a second air valve, said body being substantially yoke-shaped when in a fully inflated condition and configured to have an upper surface, a lower surface and a periphery wall connecting said upper surface to said lower surface, said periphery wall defining a substantially constant large radius converging into a substantially smaller radius which generally decreases in size until converging into a reverse radius, said reverse radius inverting itself to a substantially small radius which generally increases in size until connecting with said large substantially constant radius when the main body is in the fully inflated condition, said first and second air chambers being independently inflatable for maximum comfort and proper positioning for both mother and child; and a removable cover configured to fully enclose said inflatable body and having an opening configured to receive the inflatable body, said cover fabricated using a material from the list of cotton, fleece, nylon, natural sheep skin, polypropylene, polyester, and synthetic fabric.

2. The nursing pillow of claim 1 further comprising a third chamber containing a viscous material.

3. The nursing pillow of claim 1 further comprising a removable belt for securing about a users torso.

4. The nursing pillow of claim 1 wherein the inflatable body has a width of about 30 inches, a depth of about 14 inches, and a height of about 10 inches.

* * * * *